US009064647B2

(12) United States Patent
Cuppett et al.

(10) Patent No.: US 9,064,647 B2
(45) Date of Patent: Jun. 23, 2015

(54) CONTACT ALIGNMENT STRUCTURE FOR HIGH-VOLTAGE DEAD TANK CIRCUIT BREAKERS

(75) Inventors: Matthew Cuppett, Uniontown, PA (US); Morris Tampa, Greensburg, PA (US); Beth Dahm, Pittsburgh, PA (US); Carl Kurinko, North Huntingdon, PA (US); Brant Suhrie, Eire, PA (US)

(73) Assignee: ABB Technology AG, Zurich (CH)

( * ) Notice: Subject to any disclaimer, the term of this patent is extended or adjusted under 35 U.S.C. 154(b) by 301 days.

(21) Appl. No.: 13/604,673

(22) Filed: Sep. 6, 2012

(65) Prior Publication Data

US 2014/0061162 A1 Mar. 6, 2014

(51) Int. Cl.

| | |
|---|---|
| ***H01H 33/02*** | (2006.01) |
| ***H01H 33/16*** | (2006.01) |
| ***H01H 1/34*** | (2006.01) |

(52) U.S. Cl.

CPC ..... *H01H 1/34* (2013.01); *Y10T 29/49117* (2015.01); *H01H 33/025* (2013.01); *H01H 33/16* (2013.01)

(58) Field of Classification Search

CPC ..... H01H 33/00; H01H 33/16; H01H 33/02; H01H 9/42

USPC ..... 218/43, 44, 51–59, 143; 200/339

See application file for complete search history.

(56) References Cited

U.S. PATENT DOCUMENTS

| | | | | |
|---|---|---|---|---|
| 4,250,362 | A * | 2/1981 | Cookson | 218/143 |
| 4,668,848 | A | 5/1987 | Kowalyshen et al. | |
| 5,262,605 | A * | 11/1993 | Pham et al. | 218/143 |
| 5,604,340 | A * | 2/1997 | Yamada et al. | 218/143 |
| 5,734,140 | A * | 3/1998 | Hokuto et al. | 218/143 |
| 6,201,204 | B1 * | 3/2001 | Raynaud | 218/143 |
| 8,426,760 | B2 * | 4/2013 | Holaus et al. | 218/143 |
| 2014/0076853 | A1 * | 3/2014 | Cuppett et al. | 218/143 |

FOREIGN PATENT DOCUMENTS

| | | | |
|---|---|---|---|
| DE | 3411819 | A1 | 10/1985 |
| EP | 0560588 | A2 | 9/1993 |
| FR | 2965098 | A1 | 3/2012 |
| JP | S4423865 | Y1 | 10/1969 |
| JP | 406076700 | A | 3/1994 |

OTHER PUBLICATIONS

PCT Search Report & Written Opinion in PCT/US2013/054612, dated Dec. 18, 2013.

* cited by examiner

*Primary Examiner* — Amy Cohen Johnson
*Assistant Examiner* — Marina Fishman
(74) *Attorney, Agent, or Firm* — Manelli Selter PLLC; Edward J. Stemberger

(57) ABSTRACT

Contact alignment structure aligns a contact of a circuit breaker. The circuit breaker includes the contact fixed to a conductor, and a resistor tube having a longitudinal axis. The contact alignment structure includes a tube clamp assembly for selectively coupling to a periphery of the resistor tube. A rocker assembly is coupled with the tube clamp assembly and with the conductor so that the conductor is supported by the rocker assembly only at one end of the conductor. When the rocker assembly is coupled to the conductor, the tube clamp assembly can be rotated about the periphery of the resistor tube to change a position of the contact in a first degree of freedom, and a portion of the rocker arm assembly can be moved to change a position of the contact in a second degree of freedom that is parallel to the longitudinal axis of the resistor tube.

15 Claims, 5 Drawing Sheets

CONTACT ALIGNMENT STRUCTURE FOR HIGH-VOLTAGE DEAD TANK CIRCUIT BREAKERS

FIELD

The invention relates to high-voltage dead tank circuit breakers and, more particularly, to structure for providing adjustment of a stationary contact during installation.

BACKGROUND

Circuit breakers are commonly found in substations and are operable to selectively open and close electrical connections. These circuit breakers include a stationary electrical contact that is fixed to an elongate conductor. The conductor is supported only at the base thereof. Thus, the position of the stationary or fixed contact may be out of position in the side to side or front to back positions during operation. The proper position of each stationary contact is important for dielectric and mechanical operation of the circuit breaker. Without proper alignment during installation, the arcing between the stationary and moving contact may not stay in the designated location, leading to damage of the stationary contact.

Thus, there is a need to provide a least two degrees of adjustment of a stationary contact of a circuit breaker during installation.

SUMMARY

An object of the invention is to fulfill the need referred to above. In accordance with the principles of the present invention, this objective is obtained by providing contact alignment structure for aligning a contact of a dead tank a circuit breaker. The circuit breaker includes the contact fixed to an elongated conductor, and includes a resistor tube having a longitudinal axis. The contact alignment structure includes a tube clamp assembly constructed and arranged to be selectively coupled to a periphery of the resistor tube. A rocker assembly is coupled with the tube clamp assembly and is constructed and arranged to be coupled with the conductor so that the conductor is supported by the rocker assembly only at one end of the conductor. When the rocker assembly is coupled to the conductor, the tube clamp assembly can be rotated about the periphery of the resistor tube to change a position of the contact in a first degree of freedom, and at least a portion of the rocker arm assembly that is coupled to the conductor can be moved to change a position of the contact in a second degree of freedom that is parallel to the longitudinal axis of the resistor tube.

In accordance with another aspect of the disclosed embodiment, a method enables alignment of a stationary contact with a movable contact of a dead tank circuit breaker. The method provides the stationary contact on an elongated conductor. The conductor is mounted to a fixed member of the circuit breaker so that the conductor is supported only at a base thereof. The conductor and thus the contact are permitted to be adjusted in first and second degrees of freedom with respect to the fixed member. The conductor and thus the contact are then secured in an operating position so as to be fixed with respect to the fixed member.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF EXEMPLARY EMBODIMENTS

Figure 1:
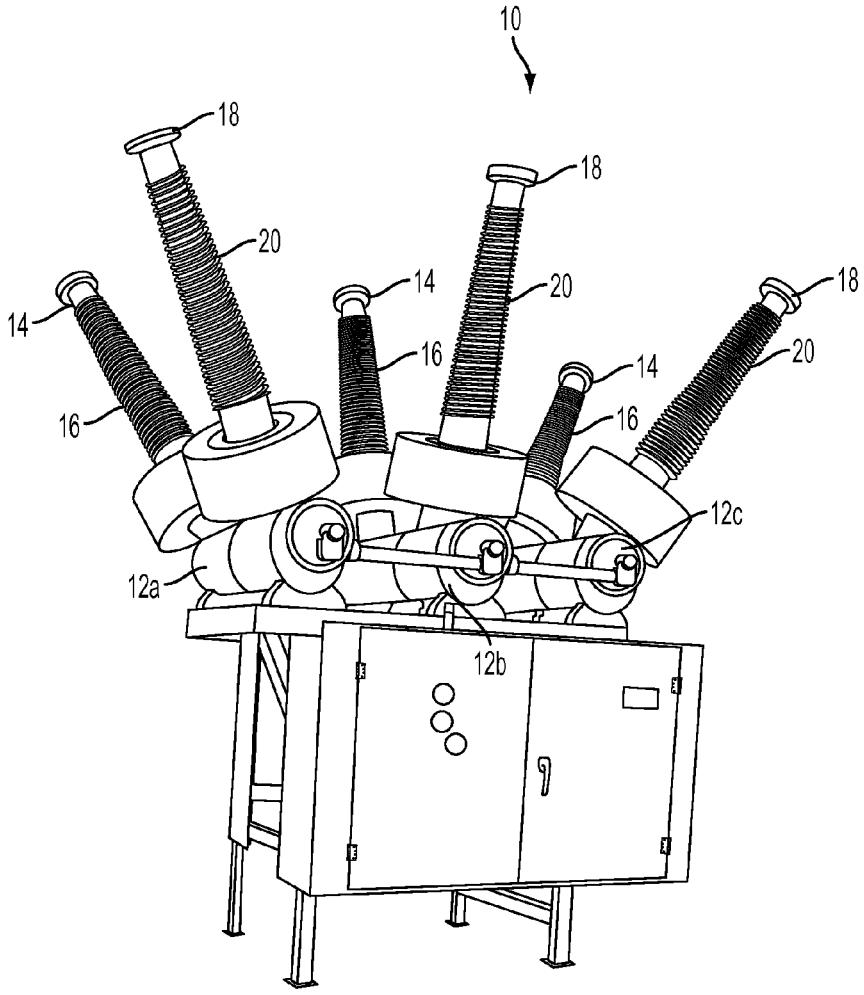
FIG. 1 is a view of a high voltage circuit breaker provided in accordance with an embodiment.

With reference to FIG. 1, a high-voltage, dead-tank circuit breaker is shown, generally indicated at 10. Circuit breaker 10 is preferably a three phase circuit breaker and thus includes three pole assemblies 12*a*, 12*b* and 12*c*. Each pole assembly 12 includes a first electrical conductor 14 carried in a first bushing 16 and a second electrical conductor 18 carried in a second bushing 20. Electrical power lines are coupled to the first and second electrical conductors 14 and 18, and the circuit breaker 10 selectively opens or closes the electrical connection there-between. It can be appreciated that the number of pole assemblies 12 can be selected for the desired application and need not be limited to three.

Figure 2:
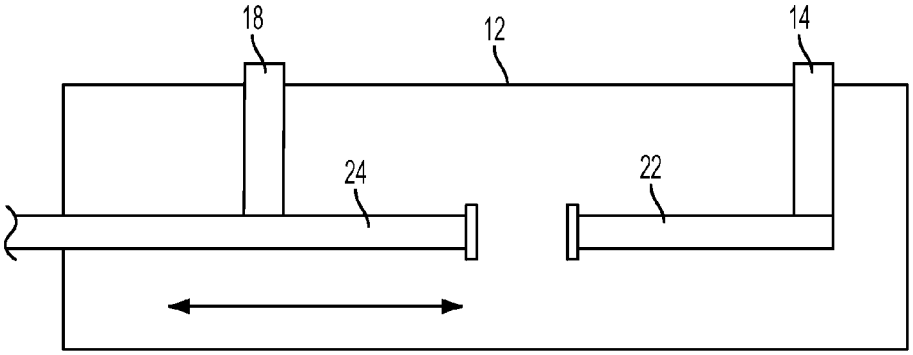
FIG. 2 is a schematic view of an interior of a breaker pole of the circuit breaker of FIG. 1, wherein the electrical contacts are open.

With reference to FIG. 2, a simplified view of an interior of a pole assembly 12 is shown, wherein first electrical conductor 14 is electrically connected to a stationary contact 22 which is immovably secured within pole assembly 12. Second electrical conductor 18 is electrically connected to a movable contact 24 which is carried within pole assembly 12 in a manner allowing longitudinal movement therein. Thus, in a first position, the movable contact 24 may be positioned to break the electrical connection between first the electrical conductor 14 and second electrical conductor 18 (FIG. 2). In a second position, the movable contact 24 may be brought into contact with stationary contact 22 to electrically connect the first electrical conductor 14 and the second electrical conductor 18. An interrupter 25 is provided in each pole assembly and the interior space of the pole assemblies 12 are sealed and generally adapted to minimize arcing between stationary contact 22 and movable contact 24. The interior volume of pole assembly 12 may be filled with dielectric material that preferably includes SF6, dry air, dry nitrogen, $CO_2$ or oil. Alternatively, a vacuum-type interrupter could be employed within the tank volume surrounded by dielectric materials mentioned.

Figure 3:
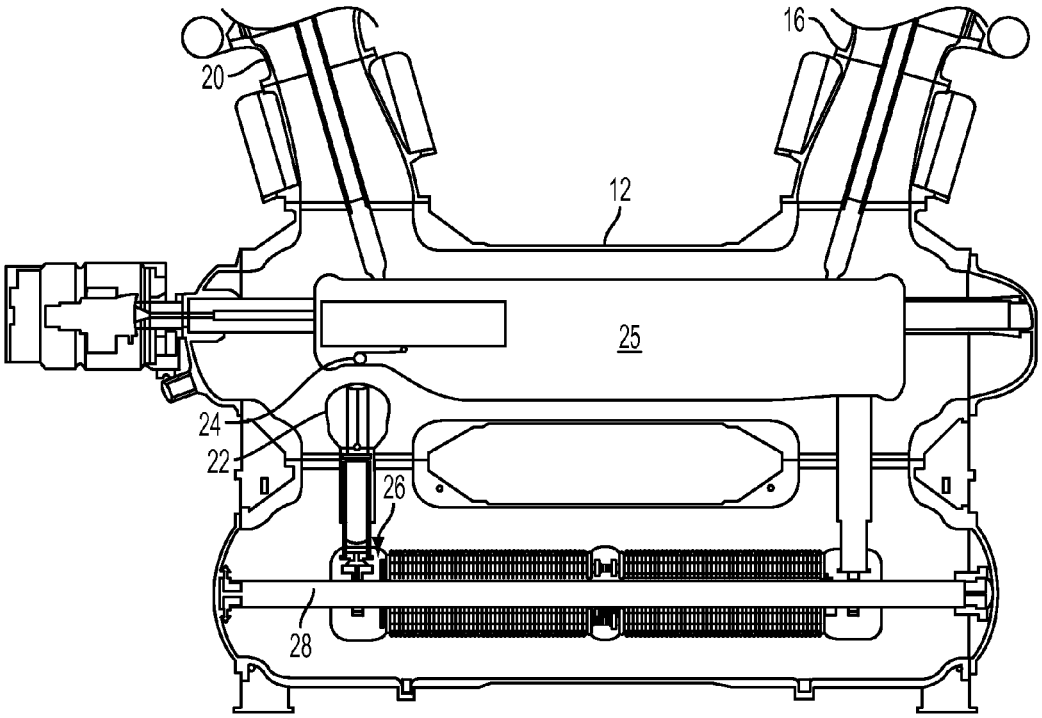
FIG. 3 is a view of an interior of a breaker pole of the circuit breaker of FIG. 1, showing contact alignment structure of embodiment.
Figure 4:
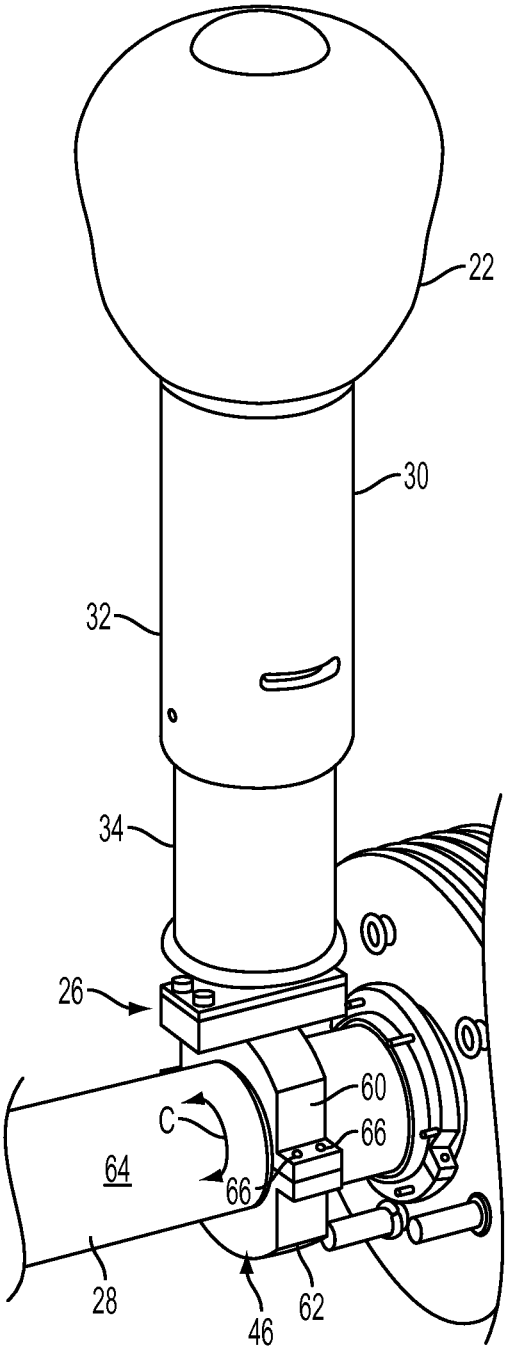
FIG. 4 is an enlarged view of the contact alignment structure of FIG. 3, shown mounted to a conductor and a resistor tube.
Figure 5:
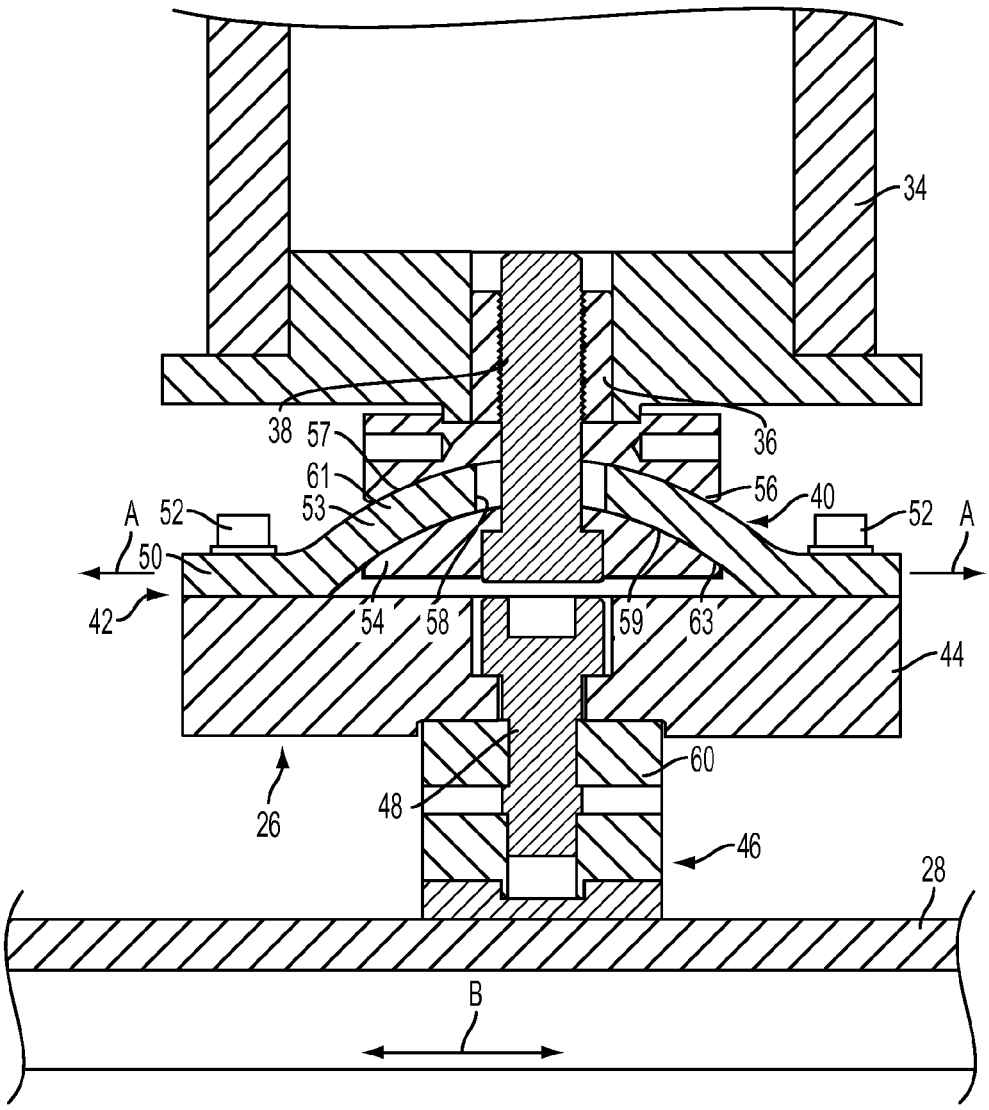
FIG. 5 is a sectional view of the rocker assembly of the contact alignment structure of FIG. 4.

When a stationary contact 22 is fixed to an elongate conductor, the probability of misalignment of the contact 22 is increased. Thus, with reference to FIGS. 3-5, a contact alignment structure, generally indicated at 26, is associated with the contact 22 and with a fixed member, such as a resistor tube 28, for aligning the contact 22 during installation. Thus, although the contact 22 is described as a stationary contact, it is movable during installation to a proper operating position and then is fixed with respect to the resistor tube 28. As best shown in FIG. 4, the stationary contact 22 is coupled with the elongate conductor 30. The conductor 30 can be comprised of one or more pieces that, as a system, provide a rigid structure. In the embodiment, the conductor 30 includes a top piece 32 coupled to a bottom piece 34. As best shown in FIG. 5, the bottom piece 34 includes an internally treaded member 36 that is in threaded engagement with a fastener such as a bolt 38 of a rocker clamp structure, generally indicated at 40. The rocker clamp structure 40 can be considered to be part of a rocker assembly, generally indicated at 42.

In the embodiment of FIG. 5, the rocker assembly 42 also includes a base 44 that is fixed to a tube clamp assembly, generally indicated at 46, via a fastener such as a bolt 48. The tube clamp assembly 46 is part of the contact alignment structure 26 and the function of assembly 46 will be explained below. The rocker assembly 42 also includes a housing 50 that is coupled to the base 44 by fasteners 52. A clamped member 53 of the housing 50 is disposed between first and second clamping portions 54 and 56, respectively, of the rocker clamp structure 40. The clamping portions 54 and 56 are in spaced relation and preferably have arc shaped surfaces 57 and 59. The clamped member 53 preferably has arc shaped surfaces 61 and 63 that mate with surfaces 57 and 59, respectively.

During installation, the conductor 30 is torqued onto the bolt 38. As torque is applied, the clamping portions 54 and 56 of the rocker clamp structure 40 sandwich the clamped member 53 of the housing 50, generating a clamping or locking force between the conductor 30 and the rocker clamp structure 40. Thus, the conductor 30 is supported in a fixed manner only at the base or bottom piece 34 thereof.

As shown in FIG. 5, a bore 58 defined through the clamped member 53 of the housing 50. The bolt 38 passes through the bore 58. The bore 58 diameter is enlarged relative to the outer diameter of the bolt 38. In this way, during the torqueing operation mentioned above, the clamping portion 56 can be clamped at various locations, along the directions of arrows A in FIG. 5, on surface 57 of the clamped member 53. This adjusts the location of the contact 22 in a degree of freedom parallel to a longitudinal axis B of the resistor tube 28.

With reference to FIG. 4, the tube clamp assembly 46 of the contact alignment structure 26 preferably includes a first portion coupled with the base 44 and a second portion 62. The portions 60 and 62 cooperate to substantially encircle the periphery 64 of the resistor tube 28 and are clamped via fasteners 66 to secure the tube clamp assembly 46 to the resistor tube 28. During installation, if adjustment of the contact 22 is needed in the radial direction of arrows C in FIG. 4 (another degree of freedom), the tube clamp assembly 46 can be rotated with respect to the periphery 64 of the resistor tube 28 and then clamped in the desired position using fasteners 66.

Figure 6:
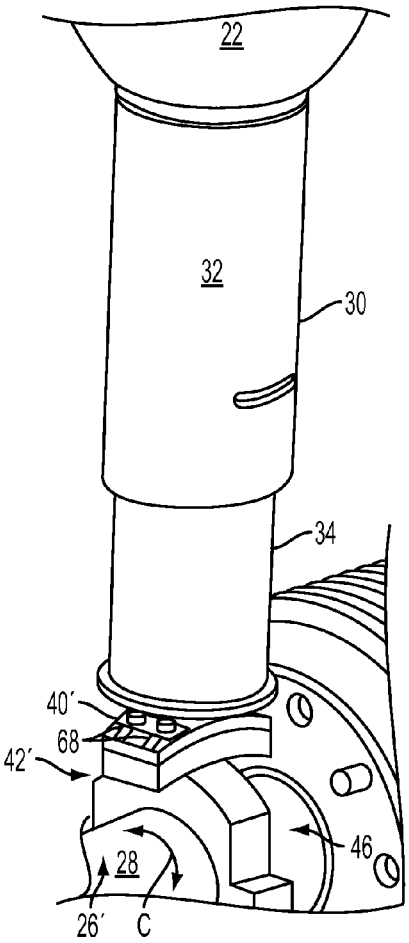
FIG. 6 is a view of another embodiment of contact alignment structure shown mounted to a conductor and a resistor tube.
Figure 7:
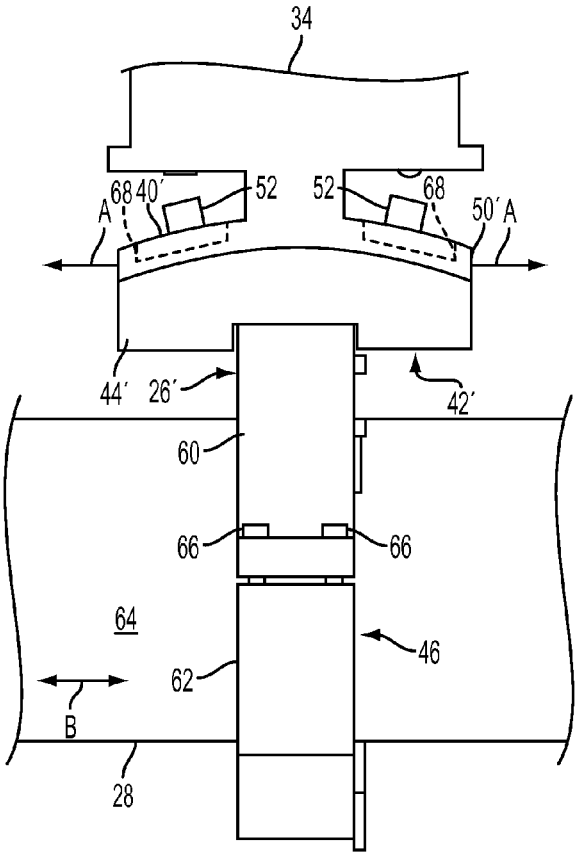
FIG. 7 is side view of the contact alignment structure of FIG. 6.

With reference to FIGS. 6 and 7, a second embodiment of the rocker assembly is shown, generally indicated at 42'. The tube clamp assembly 46 is the same as in embodiment of FIGS. 4 and 5. The rocker arm 42' includes a base 44' coupled to the upper portion 60 of the tube clamp assembly 46 by a bolt or the like. Housing 50' is coupled to the bottom piece 34 of the conductor 30 via a bolt or the like. The housing 50' is also coupled to the base 44' by being sandwiched between a rocker clamp 40' and the base 44' using fasteners 52, which are threadedly engaged with the base 44'. In order to provide adjustment of the housing 50' and thus the contact 22 relative to the resistor tube 28 during installation, slots 68 are provided in the housing 50'. The slots 68 extend in the directions of arrows A in FIG. 7. The housing 50' may be moved in the directions of arrows A and, when in the desired position, can then be secured to the base 44' via the rocker clamp 40' and fasteners 52, extending through the slots 68 and into engagement with the base 44'. Thus, as in the embodiment of FIGS. 4 and 5, this linear movement during installation adjusts the location of the contact 22 in a degree of freedom relative to a longitudinal axis B of the resistor tube 28. During installation, if adjustment of the contact 22 is needed in the radial direction of arrows C (FIG. 6), the tube clamp assembly 46 can be rotated with respect to the periphery 64 of the resistor tube 28 and then clamped in the desired position using fasteners 66.

Thus, with the contact alignment structures 26 and 26', the stationary contact 22 can be adjusted in two degrees of freedom relative to the resistor tube 28 during installation. This adjustment ensures the proper alignment of the stationary contact 22 with the movable contact 24 for proper dielectric and mechanical operation of the circuit breaker 10. Once adjusted or aligned, the conductor 30 and thus the stationary contact 22 is secured in the operating position so as to be fixed relative to the resistor tube 28.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A contact alignment structure for aligning a contact of a dead tank circuit breaker, the circuit breaker including the contact fixed to an elongated conductor, and including a resistor tube having a longitudinal axis, the contact alignment structure comprising:

a tube clamp assembly constructed and arranged to be selectively coupled to a periphery of the resistor tube, and a rocker assembly coupled with the tube clamp assembly and constructed and arranged to be coupled with the conductor so that the conductor is supported by the rocker assembly only at one end of the conductor, wherein, when the rocker assembly is coupled to the conductor, the tube clamp assembly can be rotated about the periphery of the resistor tube to change a position of the contact in a first degree of freedom, and at least a portion of the rocker arm assembly that is coupled to the conductor can be moved to change a position of the contact in a second degree of freedom that is parallel to the longitudinal axis of the resistor tube.

2. The contact alignment structure of claim 1, wherein the tube clamp assembly comprises a first portion and a second portion, the first and second portions cooperating to substantially encircle the periphery of the resistor tube and are constructed and arranged to be clamped together to secure the tube clamp assembly to the resistor tube.

3. The contact alignment structure of claim 2, wherein the rocker assembly includes a base, a housing coupled to the base, and rocker clamp structure clamping the housing to the base.

4. The contact alignment structure of claim 3, wherein the base is fixedly coupled to one of the portions of the tube clamp assembly.

5. The contact alignment structure of claim 4, further comprising a fastener coupling the base to the one portion of the tube clamp assembly.

6. The contact alignment structure of claim 3, wherein the rocker clamp structure comprises:

a fastener constructed and arranged to be threadedly engaged with the conductor, a first clamping portion, and a second clamping portion spaced from the first clamping portion, wherein the housing has a clamped member sandwiched between the first and second clamping portions.

7. The contact alignment structure of claim 6, wherein each of the first and second clamping portions has an arc shaped surface that engages a mating arc shaped surface of the clamped member of the housing.

8. The contact alignment structure of claim 6, wherein the clamped member includes a bore there-through, the fastener being a bolt passing through the bore, the bore having a diameter greater than an outer diameter of the bolt to permit adjustment of the contact in the second degree of freedom prior to clamping housing to the base.

9. The contact alignment structure of claim 4, wherein the housing includes slots therein, fasteners extend through the slots, the slots permitting the housing to be moved in the second degree of freedom, with the fasteners engaging the base to clamp the housing, when in the desired position, between the base and the rocker clamp structure.

10. The contact alignment structure of claim 1, in combination with the contact fixed to the elongated conductor, and in combination with the resistor tube.

11. The combination of claim 10, wherein the resistor tube, the elongated conductor and the contact are each disposed in a sealed pole assembly of the circuit breaker.

12. A method of aligning a stationary contact with a movable contact of a dead tank circuit breaker, the method comprising the steps of:

providing the stationary contact on an elongated conductor, mounting the conductor to a fixed member of the circuit breaker so that the conductor is supported only at a base thereof, permitting the conductor and thus the contact to be adjusted in a radial direction and a linear direction with respect to the fixed member, and securing the conductor and thus the contact in an operating position so as to be fixed with respect to the fixed member, wherein the fixed member is a resistor tube having a periphery and a longitudinal axis, a tube clamp assembly is provided and a rocker assembly is coupled with the tube clamp assembly and to the conductor, the method further comprising:

rotating the tube clamp assembly about the periphery of the resistor tube to change a position of the contact in the radial direction and then securing the tube clamp assembly to the resistor tube, and moving at least a portion of the rocker assembly to change a position of the contact in the linear direction that is parallel to the longitudinal axis of the resistor tube.

13. The method of claim 12, wherein the tube clamp assembly comprises a first portion and a second portion, the first and second portions cooperating to substantially encircle the periphery of the resistor tube, the step of securing the tube clamp assembly includes clamping the first and second portions together around the periphery of the resistor tube.

14. The method of claim 12, wherein the rocker assembly includes a base, a housing coupled to the base and rocker clamp structure clamping the housing to the base, the rocker clamp structure comprising:

a bolt threadedly engaged with the conductor, a first clamping portion, and a second clamping portion spaced from the first clamping portion, wherein the housing has a clamped member sandwiched between the first and second clamping portions and the clamped member includes a bore there-through, the bolt passing through the bore, the bore having a diameter greater than an outer diameter of the bolt such that the moving step includes torqueing the conductor on the bolt so that the clamping portion can be clamped at various locations on a surface of the clamped member.

15. The method of claim 12, wherein the rocker assembly includes a base, a housing coupled to the base, and rocker clamp structure for clamping the housing to the base, the housing including slots therein with fasteners extending through the slots, wherein the moving step includes utilizing the slots and moving the housing in the linear direction, and when the housing is in the desired position, engaging the fasteners with the base to clamp the housing between the base and the rocker clamp structure.

* * * * *